United States Patent [19]

Haubenhofer

[11] 4,409,941

[45] Oct. 18, 1983

[54] CONTROL SYSTEM FOR INTERNAL COMBUSTION ENGINES

[76] Inventor: Max Haubenhofer, 5/1 Wittekweg, 8010 Graz, Austria

[21] Appl. No.: 276,343

[22] PCT Filed: Oct. 16, 1980

[86] PCT No.: PCT/AT80/00033

§ 371 Date: Jun. 12, 1981

§ 102(e) Date: Jun. 12, 1981

[30] Foreign Application Priority Data

Oct. 16, 1979 [AT] Austria ..... 6738/79

[51] Int. Cl.[3] ..... F02D 1/04

[52] U.S. Cl. ..... 123/373; 123/501; 123/502

[58] Field of Search ..... 123/372, 373, 365, 368, 123/501, 502

[56] References Cited

U.S. PATENT DOCUMENTS

| | | | |
|---|---|---|---|
| 3,645,097 | 2/1972 | Tanaka | 60/467 |
| 4,109,628 | 8/1978 | Miller et al. | 123/372 |
| 4,150,650 | 4/1979 | Tsumura | 123/373 |
| 4,174,694 | 11/1979 | Wessel et al. | 123/365 |

*Primary Examiner*—William A. Cuchlinski, Jr.
*Attorney, Agent, or Firm*—Watson, Cole, Grindle & Watson

[57] ABSTRACT

A control system for adjusting the fuel injection pump and other auxiliary assemblies associated with a fuel injected internal combustion engine includes a mechanical centrifugal governor which is spring loaded and is connected to adjust the operation of the fuel injection pump based on the rate of rotation of a control shaft of the engine, the governor including an axially movable end support member for the spring, and a servomotor which is operatively connected to the end support member and to an auxiliary assembly such that it adjusts the operation of the auxiliary assembly based on the axial positioning of the end support member.

12 Claims, 4 Drawing Figures

CONTROL SYSTEM FOR INTERNAL COMBUSTION ENGINES

The invention relates to a control system for an internal combustion engine with fuel injection, comprising a mechanical centrifugal governor, the end support of whose spring mechanism is constructed to be axially movable.

A similar type of control system is described in Swiss Pat. No. 171,817. This known type of design does not include a rigid connection between the control device for the start of fuel injection and the device for adjusting the load of the governor, as for some engines it will be of advantage not to vary the timing of the beginning of injection in the lower speed ranges, or to set it at a slightly earlier point in time than a rigid coupling would do in order to ensure stable idling.

The object of the present invention is entirely different. In addition to the control of its load, the mechanical centrifugal governor is designed to control other functions and auxiliary devices of the internal combustion engine. For example, it can adjust the injection timing of the fuel injection pump or to control some complex process of adjustment. In such cases considerable additional activating forces will have to be supplied which the centrifugal governor cannot provide directly or which it can only generate after a considerable increase of its working capacity and thus of its dimensions and weight. Therefore servor mechanisms will have to be provided for operating these auxiliary assemblies of the internal combustion engine, which however will require a separate speed-dependent control signal.

Such signals are usually generated—e.g. in single piston fuels pumps—by using the fuel pump, whose output volume is determined by the engine speed, as a signal source. The pressure for a working piston is obtained by way of a reducing valve, the accuracy and working capacity of this control system being rather poor, however.

Another known method comprises the use of an additional speedometer, e.g., a mechanical centrifugal governor, which drives a hydraulic power amplifier. Although this set-up will guarantee a high degree of accuracy and its working capacity will depend on the dimensions of the power amplifier only, a considerable constructional effort is required in this case.

It is an object of the present invention to design a control system of the aforementioned type in such a way as to permit the derivation of additional speed-dependent signals from the centrifugal governor, without having to increase its dimensions and its weight.

The present invention achieves this first of all by means of a servomotor for auxiliary assemblies of the internal combustion engine, whose control mechanism is activated by the speed-dependent force of the spring mechanism which is exerted on the end support. The speed-dependent force fed into the spring mechanism by the flyweights of the governor is transmitted to the control mechanism of a servomotor. Thus the additional speed-dependent signal is derived from the centrifugal governor without affecting the proper function of the governor as a means for adjusting the regulating rods of the injection pumps and without reducing its service reliability.

According to a further aspect of the invention the movability of the end support can be limited to a very small range by means of stops or by the control mechanism itself. This will limit interference with the function of the governor, thereby increasing the operational safety of the entire control system even further.

In a preferred embodiment of the invention the spring mechanism of the mechanical centrifugal governor resembles that of a per se known idling and maximum speed governor, whose simple design is particularly well suited for the control system envisaged by the present invention. Further to the invention, the spring mechanism of the centrifugal governor, which is arranged in the end support, may contain an adapting device of a per se known type, which will eliminate the need for an additional adapting device driven by the servomotor.

Another version of the present invention suggests that the servomotor be driven by hydraulic force, which permits large setting forces and a comparatively simple control, while its control mechanism is repositioned by spring action. Due to this continual repositioning of the control mechanism by the servomotor itself, the proper function of the governor is even less influenced by the derivation of the signal from the axial movement of the end support of the spring mechanism.

As is proposed in another variant of the present invention, it will be of particular advantage to actuate the servomotor electrically and to utilize spring action for repositioning its control mechanism in a per se known manner, as this will greatly enhance the control of any speed-dependent auxiliary assembly of the internal combustion engine by its own servomotor as envisaged by the present invention.

Elaborating on this design, the control mechanism of this servomotor or these servomotors, respectively, comprises a force pick-up located between the end support and the housing of the control system, which actuates an electronic control unit by means of an electric signal depending on the force exerted by the end support. In a highly sensitive and reliable manner this will generate an electric signal corresponding to the speed-dependent force exerted on the spring mechanism. At the same time a simple stop is formed checking the movement of the end support of the spring mechanism relative to the control assembly.

In further elaboration of the invention, the electronic control unit may be constituted by a microprocessor which can be fed further operating characteristics of the internal combustion engine, e.g., boost pressure, ambient temperature, position of ignition lock, accelerator, regulating rod etc., and which will control the servomotor in accordance with these data. Due to this microprocessor any factors influencing the performance of the internal combustion engine may be taken into account according to a preselected program, which will ensure optimum adjustment of the auxiliary devices in accordance with the operational state of the engine.

Finally, the electrically actuated servomotors may be configured as stepping motors, which will further simplify and improve precise and reproducible adjustment of the auxiliary devices.

Following is a more detailed description of exemplary embodiments of the invention as illustrated schematically in the enclosed drawings, wherein FIG. 1 shows a control system embodying the present invention with an hydraulically actuated servomotor;

Figure 1:
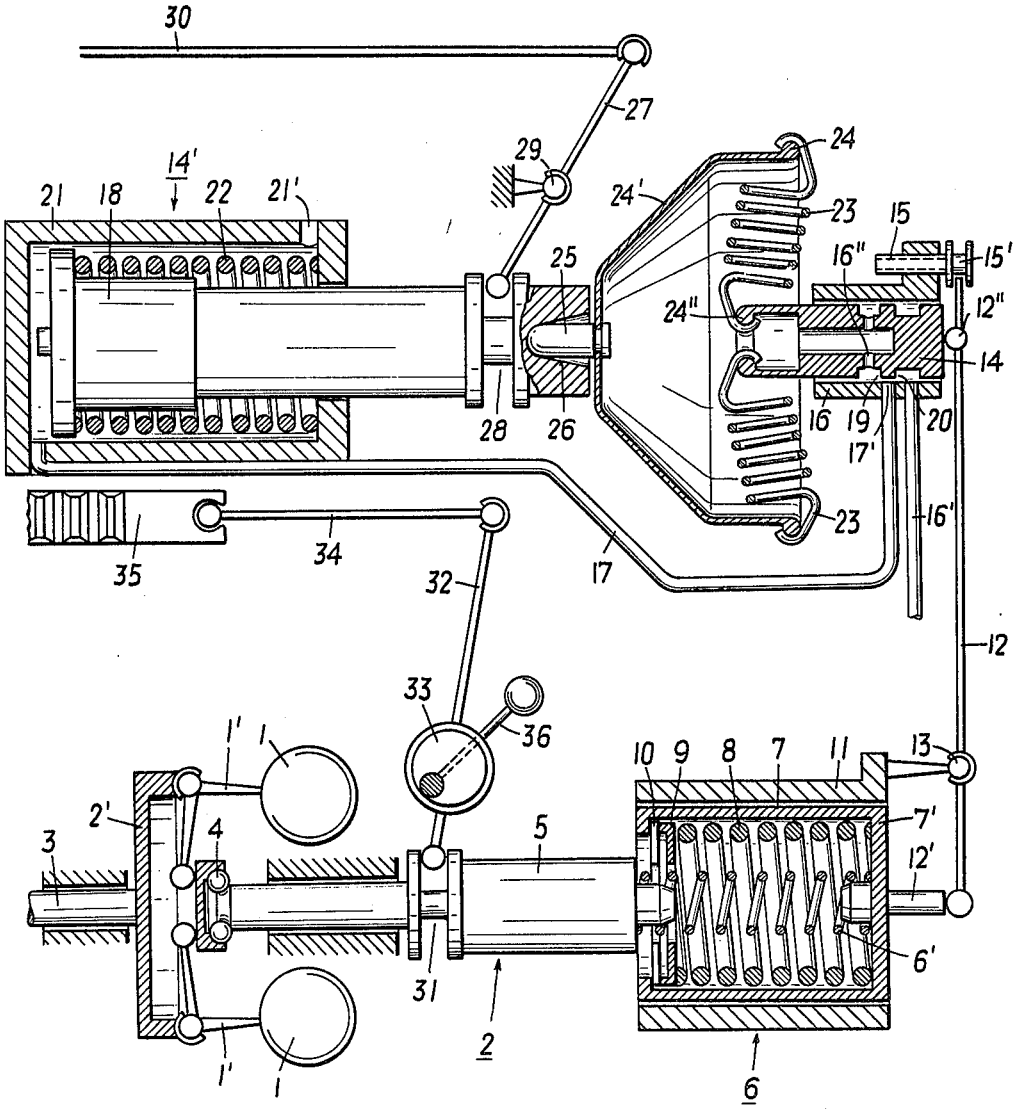

In FIG. 1 the flyweights 1 of the centrifugal governor 2, which are attached to the two-armed bell-crank levers 1' and are carried by the support 2' and are driven by the shaft 3, actuate the sleeve 5 via the ball bearing 4. The spring mechanism 6 of the governor is of the type usually applied in idling and maximum speed governors. A cartridge-shaped end support 7, which is axially movable relative to the housing 11 of the governor, contains the idler spring 6' situated between the sleeve 5 and the bottom 7' of the cartridge 7. The cartridge 7 also contains the main spring 8 as well as a spring cap 9 and an adapting spring 10.

The force generated by the flyweights 1 is fed into the cartridge 7 by way of the two-armed bell-crank levers 1' and the sleeve 5, and is not absorbed by the governor housing 11, as is usual in governors of the known type, but is transmitted via the projection 12' to the two-armed lever 12 supported by the bearing 13 attached to the housing 11, and is then transmitted to the slide valve 14 controlling a servomotor 14'. The mobility of the lever 12 is checked by a double stop 15' which can be adjusted by a screw 15, thereby reducing the free axial movement of the cartridge 7 relative to the housing 11 to a small range and minimising interference with the control function of the centrifugal governor 2.

The slide valve 14 is actuated by the two-armed lever 12 via a nose 12" and slides axially in the bushing 16 which is provided with a pressure fluid inlet 16' and openings 17' for the hydraulic line 17 leading to the cylinder 21 of the hydraulic servomotor 14'. The control edges 19 and 20 of the slide valve 14 combine with the openings 17', thus providing a speed-dependent actuation of the working piston 18. The working piston 18 slides in the cylinder 21 which has a vent hole 21' on its right hand end (cf. drawing).

The working piston 18, which is loaded by the spring 22 on one side and is subjected to the pressure of the hydraulic fluid on the other, can provide a working force in either direction.

The force exerted on the sleeve 5 which is generated by the flyweights 1 and is speed-dependent, is transmitted first to the lever 12 and then to the slide valve 14 by way of the nose 12". The slide valve 14 is loaded by springs 23 which generate a force component in the axial direction of the slide valve and take up the force exerted upon the slide valve. The springs 23 are hooked into a bulge 24 of the cup 24' on one end and into a bulge on the inside of the slide valve 14 on the other end, with the cup 24' being supported in a bore 26 of the working piston 18 by means of a central pin 25 opposite of the springs 23.

If the equilibrium of forces at the slide valve 14 is disturbed by a change of position of the lever caused by the centrifugal governor 2, the slide valve 14 will be displaced within the limits set by the double stop 15, and the control edges 19 and 20 will connect the hydraulic line 17 or the openings 17' to the fluid inlet 16' or to the outlet 16", respectively. This will shift the working piston 18 in such a way as to restore by way of the springs 23 the equilibrium of forces at the slide valve 14 as the openings 17' are covered by the slide valve 14.

The setting force is derived from the working piston 18 of the servomotor 14' by means of a two-armed lever 27 which engages in a groove 28 of the working piston and is pivoted on the housing by means of a bearing 29 moving a connecting rod 30 longitudinally.

The control force of the centrifugal governor 2 is directly obtained by way of a two-armed control lever 32 travelling in the circular groove 31 of the sleeve 5. The control lever 32 is carried by an eccentric shaft 33 and transmits the speed-dependent motion of the control sleeve 5 via the control linkage 34 to the regulating rod 35 of an injection pump not shown in the drawing. The eccentric shaft 33 also carries the operating lever 36 for the control of the desired injection pump.

Figure 2:
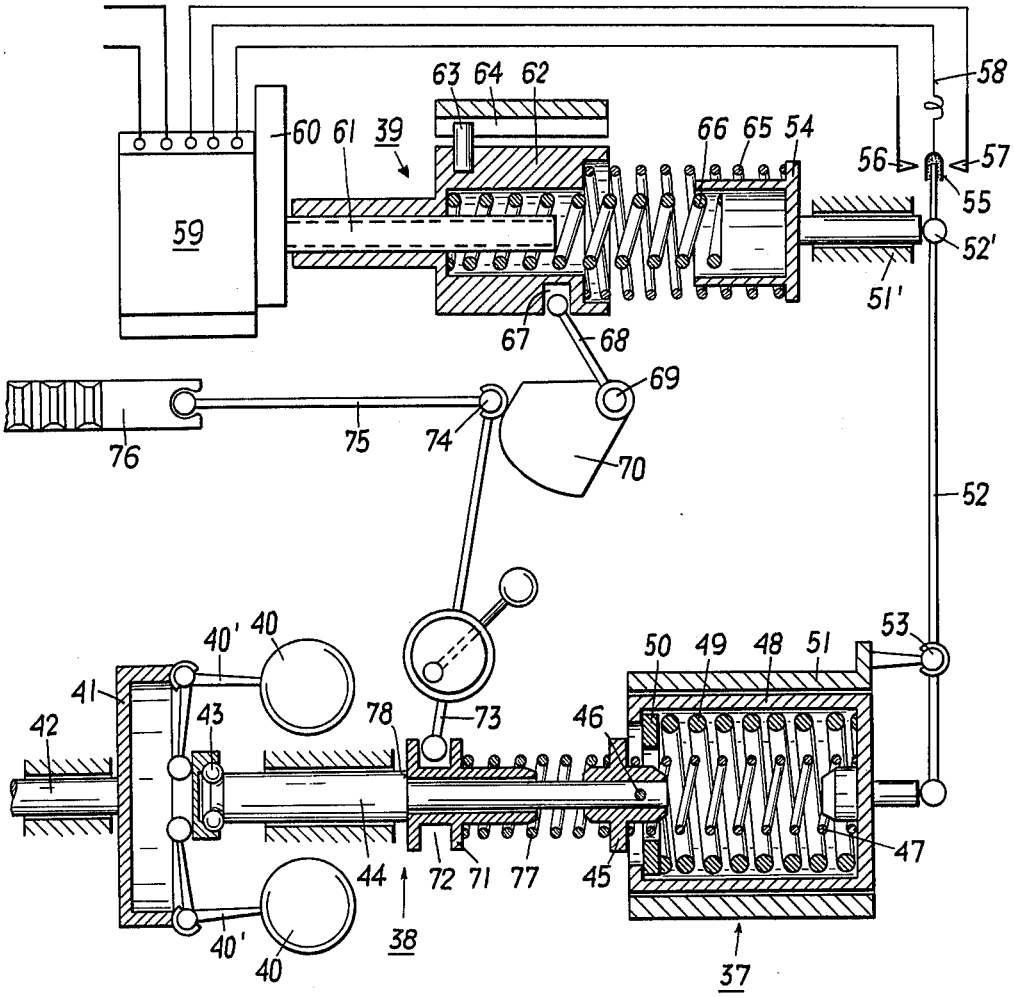
FIG. 2 shows an embodiment with an electrically actuated servomotor.

The embodiment shown in FIG. 2 differs from that in FIG. 1 insofar as the spring mechanism 37 of the centrifugal governor 38 does not incorporate an adjustment device, instead of which the servomotor 39 is equipped with a separate cam 70 for so-called plus-minus adjustment. Moreover, the servomotor 39 is driven by electric power. The flyweights 40 of the centrifugal governor 38 are mounted on the support 41 by means of bell-crank levers 40' and are driven by the internal combustion engine via the shaft 42. The motion of the flyweights 40 is transmitted via the bell cranks and the ball bearing 43 to a sleeve 44 which is provided with a spring cap 45 fastened with a pin 46 to the sleeve end opposite of the ball bearing 43. An idler spring 47 acts upon the spring cap 45 on the one side and is supported by the cartridge-shaped end support 48 on the other, which also comprises the main spring 49 pressing against the spring cap 50.

The cartridge 48 is axially movable in the housing 51 and will transmit the speed-dependent force exerted onto the spring mechanism 37 by the sleeve 44 to a two-armed lever 52 which is swivel-mounted to the housing 51 by means of a bearing 53.

The other end of the lever 52 carries a contact cap 55 which is insulated against the lever and connects the power supply line 58 with the terminals of the electric motor 59 via the contacts 56 and 57. By way of a gear 60 the electric motor 59 moves the spindle 61 carrying a nut 62 which is prevented from turning by the use of a pin 63 sliding in an axial groove 64 in the housing.

The springs 65 and 66, which act upon a spring cap 54 successively, depending on the distance travelled by the nut 62, exert pressure on the nose 52' of the two-armed lever 52 interacting with the contacts 56 and 57 via the spring cap 54 which is axially movable in the housing 51'.

The control force is derived from the servomotor 39 by means of a lever 68 fitting into the recess 67 of the nut 62, which transmits the motion of the nut 62 onto a shaft 69. This shaft is provided with a cam 70 serving for the control of the adjustment process.

Since the force, which originates in the mass of the flyweights and is transmitted to the cartridge of the speed governor serving as an end support for the spring mechanism, and thus to the control device of the servomotor, is dependent on the square of the angular velocity, it will be of advantage to provide either a combination or arrangement of springs according to the variant illustrated in FIG. 1 which pays full consideration to this square law, or at least a combination of two springs as illustrated in FIG. 2, which will at least permit an extension of the displacement/angular velocity characteristic of the servomotor and the nut 62 within the lower speed range of the internal combustion engine.

The speed-dependent motion of the sleeve 44 of the centrifugal governor 38 in FIG. 2 is transmitted to the auxiliary sleeve 71 which has a circular groove 72 guiding a control lever 73. When the injection pump (not shown in this drawing ) operates at full volume, the other end 74 of the lever rests against the cam 70 and moves the regulating rod 76 for varying the injection volume by means of a rod 75.

The auxiliary sleeve 71 is acted upon by a spring 77 whose other end presses against the side of the spring cap 45 opposite to the idler spring 47. At injection volumes where the end 74 of the control lever 73 does not yet touch the cam 70, the auxiliary sleeve 71 will be pressed against the shoulder 78 of the sleeve 44 by the spring 77.

Figure 3:
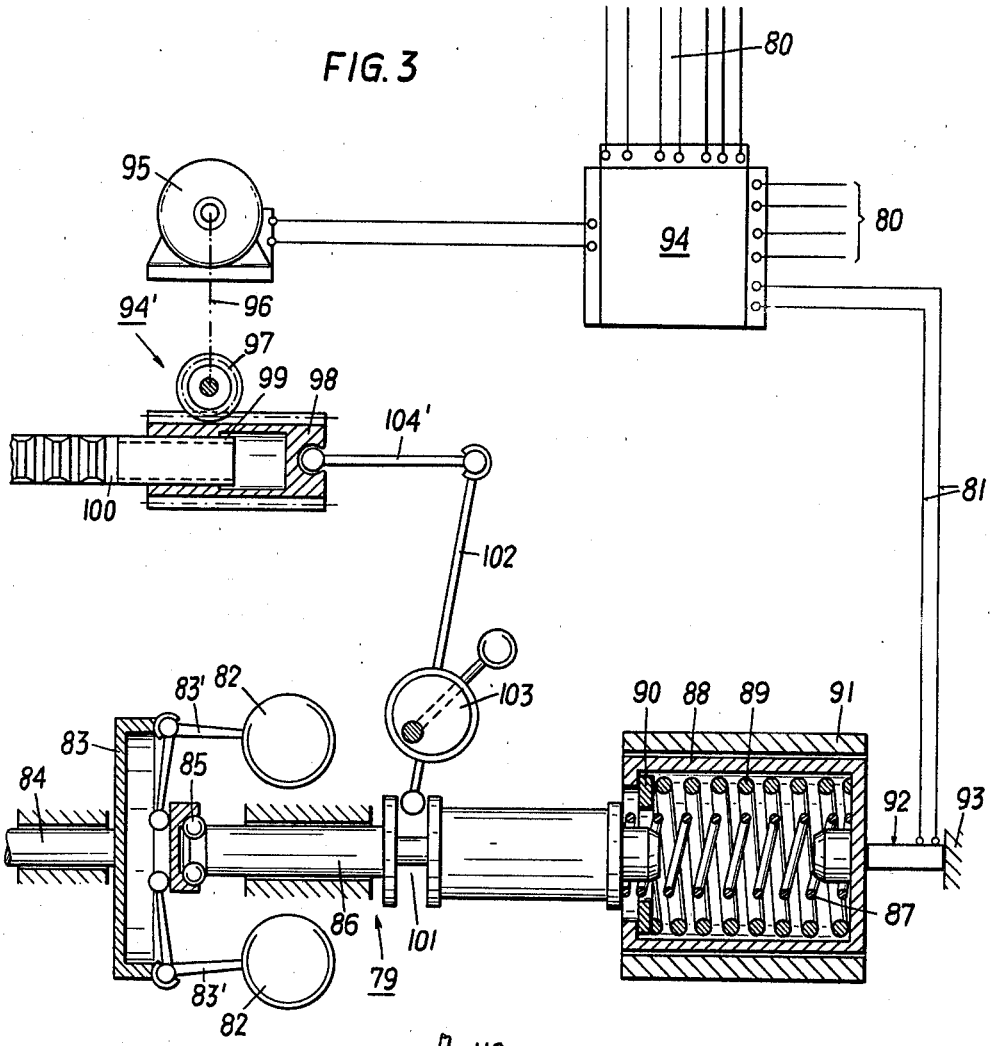
FIG. 3 shows another embodiment with an electronically controlled servomotor.

In the embodiment of the present invention shown in FIG. 3 the design of the centrifugal governor itself corresponds to that discussed under FIG. 1. The flyweights 82 which are pivoted on the support 83 by means of the bell-crank levers 83' are driven by a shaft 84 of the internal combustion engine and actuate the sleeve 86 by way of a ball bearing 85. The idler spring 87 and the main spring 89 are positioned in the support cartridge 88 as described which is axially movable relative to the housing 91, and are acted upon by the sleeve 86. As in FIG. 2 the present embodiment does not include any adjusting device in the cartridge; the main spring 89 presses directly against the spring cap 90.

The speed-dependent force fed into the cartridge 88 is transmitted to section 93 of the housing 91 via an electric force pick-up 92. The force pick-up 92 may consist of a suitably placed strain-gauge, a piezoelectric quartz or some similar device, and simultaneously constitutes a stop permitting only minimal axial motion of the cartridge 88.

The speed-dependent electric signal of the force pick-up 92 is transmitted via connectors 81 to a microprocessor 94 whose other input terminals 80 may be used for taking into account additional parameters for the control of the servomotor 94'. Such parameters are, e.g., boost pressure, ambient temperature, the temperature of the internal combustion engine or of the walls of its combustion chamber, the position of the ignition lock or of the operating linkages, the position of the regulating rod of the injection pump, etc. The microprocessor 94 combines these parameters according to a predetermined program and controls the power supply for the servomotor 95. By means of a shaft 96 and a worm 97 the servomotor 95 operates a worm wheel 98 which can shift the position of the non-rotable regulating rod 100 of the injection pump by means of a thread 99.

The sleeve 86 of the centrifugal governor 79 has a circulargroove 101 holding the two-armed control lever 102 located on the eccentric shaft 103, which connects the sleeve 86 whose motion depends on the engine speed to the worm wheel 98 and thus to the regulating rod 100 by way of a control linkage 104'.

The microprocessor 94 may be equipped with additional output terminals for the control of further servomotors which may, e.g., adjust the timing of fuel injection into the internal combustion engine.

Figure 4:
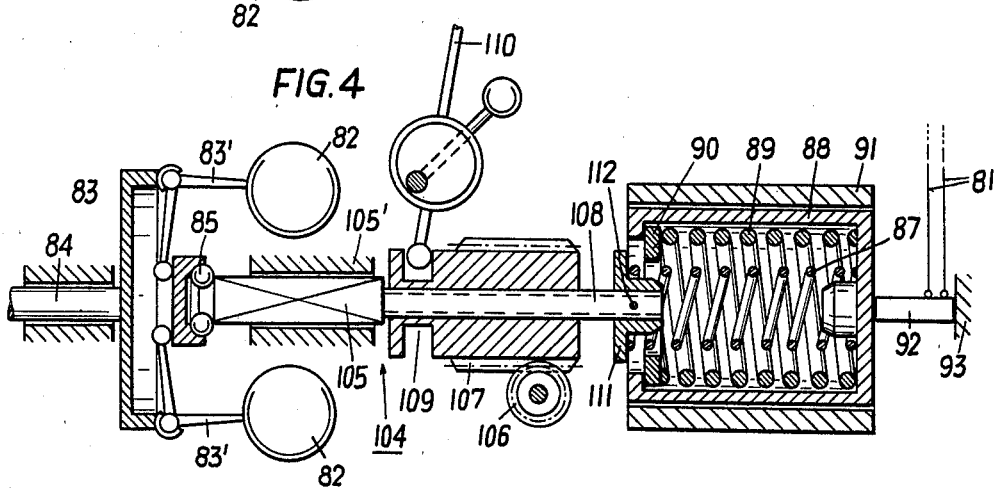
FIG. 4 shows a further embodiment of the invention with an electronically controlled servomotor.

The embodiment of the present invention shown in FIG. 4 differs from that of FIG. 3 only by the fact that the sleeve 105 of the centrifugal governor 104 cannot be rotated relative to the housing 105', and that the worm 106 of the servomotor (not shown) acts upon a worm wheel 107 serving as an auxiliary sleeve which turns on a threaded bolt 108 of the sleeve 105. The speed-dependent force is fed into the spring mechanism via the spring cap 111, which is fastened to the threaded bolt 108 with the pin 112. As the two-armed control lever 110 engages with the circular groove 109 of the worm wheel 107, this will again result in microprocessor-controlled adjustment.

I claim:

1. A control system for a fuel injected internal combustion engine which operates in conjunction with a multiplicity of auxiliary assemblies which are adjustably operable, including a fuel injection pump, said engine causing a control shaft to rotate at a rate dependent on its operating speed, said control system being capable of simultaneously adjusting the operation of said fuel injection pump and other of said multiplicity of auxiliary assemblies, said control system comprising a mechanical centrifugal governor which is loaded by a spring means and is connected to said control shaft and to said fuel injection pump so as to adjust the operation of said fuel injection pump based on the rate of rotation of said control shaft, said governor including an end support member for said spring means which is capable of moving along an axial center line which extends therethrough, and a servomotor which is operatively connected to said end support member and to one of said multiplicity of auxiliary assemblies such that, based on the axial positioning of said end support member, it will adjust the operation of said one of said multiplicity of auxiliary assemblies.

2. The control system as defined in claim 1 wherein said mechanical centrifugal governor includes a sleeve which is movable along said axial center line based on the rate of rotation of said control shaft, movement of said sleeve causing a first lever mechanism to move a regulating rod that is connected to said fuel injection pump.

3. The control system as defined in claim 2 wherein said end support member is cartridge shaped and wherein said spring means is positioned therewithin.

4. The control system as defined in claim 3 wherein said end support member includes a projection portion which extends outwardly therefrom along said axial center line, wherein said governor includes a generally cylindrical housing within which said end support member is movable, and wherein said control system includes a two-armed lever pivotally connected to said generally cylindrical housing, said two-armed lever including a first end which contacts the free end of said projection portion and a second end which contacts said servomotor.

5. The control system as defined in claim 4 wherein said servomotor includes (a) a hydraulic piston-cylinder arrangement, one end of said piston extending outwardly from said cylinder, (b) a cup means having a first end and a second end, the first end of said cup means being positioned against the end of said piston outside said cylinder and the second end of said cup means including bulge springs, (c) a cylindrical bushing, (d) a slide valve movably positioned in said cylindrical bushing, a first end of said slide valve being connected to said bulge springs and the second end of said slide valve contacting said two-armed lever near its second end, (e) first pipe means for supplying hydraulic fluid to said cylindrical bushing, (f) second pipe means connected between said cylindrical bushing and said cylinder for enabling hydraulic fluid to flow to or from said cylinder based on the positioning of said slide valve within said cylindrical bushing, which is determined by said two-armed lever, causing said piston to move in and out of said cylinder, the positioning of said piston causing a second lever mechanism to move a connecting rod attached to said one of said multiplicity of auxiliary assemblies.

6. The control system as defined in claim 5 wherein a screw is connected to said cylindrical bushing, said screw having a double-stop head, and wherein the second end of said two-armed lever is positioned within said double-stop head such that its movements are limited thereby.

7. The control system as defined in claim 4 wherein said servomotor includes (a) an electric motor which is operable to rotate a spindle attached thereto, (b) a nut which is threadingly attached to said spindle so as to move along the length of said spindle as said spindle is rotated and to concurrently cause a cam in contact with one of said multiplicity of adjustably operable auxiliary assemblies to rotate, (c) an axially movable spring cap, a first end of said spring cap contacting said two-armed lever near its second end, (d) a spring means positioned between said nut and said spring cap, (e) an electrical line connected to the second end of said two-armed lever, and (f) electrical contact means positioned on opposite sides of thesecond end of said lever and connected to said motor such that the operation of said electric motor will be based on the positioning of the second end of said two-armed lever.

8. The control system as defined in claim 3 wherein a force pick-up means is positioned in contact with said end support member to provide a varying output signal based on the force exerted thereon by said end support member, an electronic control unit, first electrical connectors for transmitting the output signal from said force pick-up means to said electronic control unit, and second electrical connectors for transmitting control signals from said electronic control unit to said servomotor.

9. The control system as defined in claim 8 wherein said servomotor includes (a) a drive motor to which said second electrical connectors are attached, (b) a worm wheel which is connected to move a connecting rod attached to said one of said multiplicity of auxiliary assemblies, and (c) a worm which is rotatable by said drive motor to move said worm wheel.

10. The control unit as defined in claim 9 wherein third electrical connectors are attached to said electronic control unit to provide input signals from various sensing elements positioned to sense various parameters which determine the operational characteristics of said engine.

11. The control unit as defined in claim 10 wherein said electronic control unit is a microprocessor.

12. The control unit as defined in claim 10 wherein fourth electrical connectors are attached to said electronic control unit to transmit output signals from said electric control unit to additional auxiliary assemblies.

* * * * *